US010197001B2

(12) United States Patent
Ahn et al.

(10) Patent No.: US 10,197,001 B2
(45) Date of Patent: Feb. 5, 2019

(54) METHOD OF CORRECTING INJECTOR CHARACTERISTIC FOR CONTROLLING CLOSING TIME OF INJECTOR

(71) Applicant: HYUNDAI MOTOR COMPANY, Seoul (KR)

(72) Inventors: Kyung-Ho Ahn, Seoul (KR); Min-Kyu Han, Hwaseong-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 15/359,001

(22) Filed: Nov. 22, 2016

(65) Prior Publication Data

US 2017/0306877 A1 Oct. 26, 2017

(30) Foreign Application Priority Data

Apr. 26, 2016 (KR) ..... 10-2016-0050778

(51) Int. Cl.
*F02D 41/20* (2006.01)
*F02D 41/24* (2006.01)

(52) U.S. Cl.
CPC ..... *F02D 41/2467* (2013.01); *F02D 41/20* (2013.01); *F02D 2041/2055* (2013.01); *F02D 2200/0602* (2013.01)

(58) Field of Classification Search
CPC .... F02D 41/2467; F02D 41/20; F02D 41/221; F02D 41/2429; F02D 41/2432;
(Continued)

(56) References Cited

U.S. PATENT DOCUMENTS 9,719,453 B2 * 8/2017 Beer ..... F02D 41/3005
2002/0002964 A1 * 1/2002 Kohketsu ..... F02D 41/221 123/447

(Continued)

FOREIGN PATENT DOCUMENTS

JP 2008-128206 A 6/2008
JP 2010-275987 A 12/2010

(Continued)

OTHER PUBLICATIONS

Korean Notice of Allowance issued in Korean Patent Application No. 10-2016-0050778, dated Nov. 20, 2017, with English Translation.

*Primary Examiner* — Lindsay Low
*Assistant Examiner* — George Jin
(74) *Attorney, Agent, or Firm* — McDermott Will & Emery LLP

(57) ABSTRACT

A method for correcting an injector characteristic defining a relationship between an injector injection time and a valve closing time for a cylinder of an internal combustion engine by sensing an injector closing time includes steps of: sensing the injector closing time; determining a compensation amount for compensating for a commanded injection time using a number of sensing failures or a result of a learning of a relationship between a required commanded injection time and the injector closing time in a relevant cylinder, in addition to the number of sensing failures when there is a failure to sense the injector closing time; and controlling a commanded injection time according to an amount of required fuel injection in the relevant cylinder, based on the determined compensation amount.

15 Claims, 8 Drawing Sheets

(58) Field of Classification Search
CPC ..... F02D 41/2438; F02D 2041/2055; F02D 2041/2037; F02D 2041/2051; F02D 1/16
See application file for complete search history.

(56) References Cited

U.S. PATENT DOCUMENTS

| | | | | |
|---|---|---|---|---|
| 2006/0180128 | A1* | 8/2006 | Saito | F02D 41/221 123/525 |
| 2014/0069390 | A1 | 3/2014 | Nishimura et al. | |
| 2015/0226148 | A1* | 8/2015 | Beer | F02D 41/247 123/480 |
| 2015/0275814 | A1* | 10/2015 | Park | F02D 41/38 239/1 |
| 2016/0076498 | A1* | 3/2016 | Aono | F02D 41/20 123/490 |
| 2016/0298566 | A1* | 10/2016 | Barth | F02D 41/2432 |
| 2017/0022928 | A1* | 1/2017 | Jin | F02D 41/401 |

FOREIGN PATENT DOCUMENTS

| | | | |
|---|---|---|---|
| JP | 2012-241677 | A | 12/2012 |
| JP | 2014-055571 | A | 3/2014 |
| KR | 10-2013-0111249 | A | 10/2013 |
| KR | 10-2013-0115301 | A | 10/2013 |
| KR | 10-2015-0040945 | A | 4/2015 |
| KR | 10-2015-0082226 | A | 7/2015 |
| KR | 10-2015-0114078 | A | 10/2015 |

* cited by examiner

METHOD OF CORRECTING INJECTOR CHARACTERISTIC FOR CONTROLLING CLOSING TIME OF INJECTOR

CROSS-REFERENCE(S) TO RELATED APPLICATIONS

This application claims the benefit of priority to Korean Patent Application No. 10-2016-0050778, filed on Apr. 26, 2016 in the Korean Intellectual Property Office, the entirety of which is incorporated herein by reference.

TECHNICAL FIELD

The present disclosure relates to a method of correcting an injector characteristic; and, particularly, to a method of correcting an injector characteristic, capable of correcting a deviation between injector closing times in cylinders by compensating for an injector driving characteristic defining a relationship between an injector injection time and a valve closing time for each cylinder of an internal combustion engine.

BACKGROUND

When fuel is supplied to a vehicle engine, the amount of supplied fuel is determined by an engine control unit ("ECU"), and an injector injects fuel into the engine according to the amount of determined fuel so that the fuel is supplied into the engine.

The injector is typically configured of a solenoid valve, and is included in each cylinder. The injector injects fuel for a predetermined injection time in response to a fuel injection signal received from the ECU, to supply the fuel into the engine by the amount of required fuel.

As disclosed in Patent Document 1, an injector has an inherent driving characteristic according to its type or manufacturer. Specifically, as illustrated in FIG. 3A, the time required to close the injector according to an amount of required fuel to fuel pressure has a specific linear relationship depending on the type or manufacturer of the injector. In addition, as illustrated in FIGS. 3B and 4A, the time required to close the injector and the commanded injection time of the injector corresponding thereto have a specific corresponding relationship for each type or manufacturer of the injector. In general, information on the nominal characteristic of the injector is stored in the memory of the ECU when the vehicle is manufactured, and is used to supply fuel into each cylinder according to the amount of required fuel.

However, as illustrated in FIG. 4B, even when the same injectors are used, injectors may have different driving characteristics due to a manufacturing tolerance, or a tolerance of an output end of each injector operated by the ECU and thus a difference in the profile of operating current. Particularly, when a deviation of an injector driving characteristic related to an injector closing time is not compensated for each cylinder, injector closing times vary for each cylinder. For this reason, different amounts of fuel are supplied for each cylinder in spite of the injection command based on the same injection time. Thus, it is difficult to perform the same flow control between cylinders.

In order to correct a deviation between a commanded injection time and an injector closing time for each cylinder, a nominal commanded injection time according to the nominal characteristic curve of the injector is compensated by measuring the actual closing time of the injector corresponding to an injection command for each cylinder, as illustrated in FIG. 4B.

The closing time of the injector is typically sensed and measured through a point of inflection obtained by the multiple differentiation of voltage derived during intermittence. However, since it is difficult to detect a point of inflection in the section of the small amount of fuel indicated by the dotted line in FIG. 4A, the closing time of the injector may not be sensed. In addition, the sensing characteristics of the injector differ for each injector in the small flow section.

As illustrated in FIG. 4B, even when the commanded injection time corresponding to the time required to close the injector is present in the region in which the closing time is sensible, there is a case in which fuel is injected in a non-sensitive region before compensation. In this case, it is problematic whether or not the injector closing time is sensed during flow control.

In particular, since a high-pressure engine is used as a gasoline direct injection ("GDI") engine due to severe environment-related regulations such as Euro 6c, it is necessary to control a small flow by enlarging a multiple fuel injection method.

Accordingly, in order to accurately control a flow deviation between injectors in respective cylinders in a small flow section, it is necessary to reduce the flow deviation between the injectors by accurately measuring the closing time of an injector valve and feedback controlling the same in the section.

However, the conventional control method when it fails to sense the closing time of the injector in the small flow section is not known. Therefore, it is determined that compensation control is performed only in the section in which a sensing failure is not present, i.e. in the section in which a time required for injection is relatively long.

In this case, since it is impossible to accurately control the time required for injection in the small flow section, it is difficult to accurately compensate for injector driving characteristics.

[Patent Document 1] Korean Patent Laid-open Publication No. 2015-0114078 (Oct. 12, 2015)

SUMMARY

An embodiment in the present disclosure is directed to a method of correcting an injector driving characteristic, capable of accurately compensating for an injector driving characteristic even in a small flow section in which it is difficult to sense an injector closing time, when compensating for the injector driving characteristic defining a relationship between an injector injection time and a valve closing time in an internal combustion engine.

Other objects and advantages of the present disclosure can be understood by the following description, and become apparent with reference to the embodiments in the present disclosure. Also, it is obvious to those skilled in the art to which the present disclosure pertains that the objects and advantages of the present disclosure can be realized by the means as claimed and combinations thereof.

In an embodiment in the present disclosure, when it fails to sense an injector closing time, a compensation amount for a required time of fuel injection is deduced as a function of the number of sensing failures of the injector closing time. Alternatively, when the learning of the injector closing time is completed, the compensation amount is calculated by deducing a sensing value through the extrapolation of a learned injector characteristic curve.

When it consistently fails to sense the injector closing time, it is difficult to accurately compensate for the injector driving characteristic since the required closing time is too small. Therefore, a multiple injection mode is changed or a multiple injection ratio is changed such that the time required to close an injector is adjusted upward.

In accordance with an embodiment in the present disclosure, a method of correcting an injector driving characteristic is a method of correcting an injector characteristic defining a relationship between an injector injection time and a valve closing time for each cylinder of an internal combustion engine by sensing an injector closing time in order to control the small closing time of the injector. The method includes sensing the injector closing time; determining a compensation amount for compensating for a commanded injection time using a number of sensing failures or a result of a learning of a relationship between a required commanded injection time and the injector closing time in a relevant cylinder, in addition to the number of sensing failures when there is a failure to sense the injector closing time; and controlling a commanded injection time according to an amount of required fuel injection in the relevant cylinder, based on the determined compensation amount.

A sensing value of the injector closing time may be determined by extrapolating a characteristic curve in which the learning is completed when the learning of the injector closing time in the relevant cylinder is completed in the step of determining the compensation amount for compensating for the commanded injection time; and the compensation amount for compensating for the commanded injection time may be determined using the determined sensing value of the injector closing time and a deviation of a time required to close an injector.

The compensation amount may be determined according to a relationship between the compensation amount and the number of sensing failures when the injector closing time in the relevant cylinder is not completed in the step of determining the compensation amount; and the compensation amount for compensating for the commanded injection time may be determined using a sensing value of the injector closing time and a deviation of a time required to close an injector.

The step of controlling the commanded injection time may comprise steps of: setting an amount of required fuel injection; calculating a time required to close an injector from the set amount of required fuel injection; calculating the required commanded injection time from the calculated time required to close an injector; and determining the commanded injection time using the calculated required commanded injection time and the determined compensation amount.

The required commanded injection time may be calculated from an injector characteristic curve in which the learning is completed when the learning of the commanded injection time and the injector closing time in the relevant cylinder is completed in the step of calculating the required commanded injection time.

The required commanded injection time may be calculated from a nominal injector characteristic curve which is previously set when a vehicle is manufactured when the learning of the commanded injection time and the injector closing time in the relevant cylinder is not completed in the step of calculating the required commanded injection time.

The commanded injection time may be compensated using the determined compensation amount when a deviation between a current injector driving condition and an injector driving condition is within a predetermined range in the step of determining the compensation amount in the step of controlling the commanded injection time.

The determined compensation amount and the sensing failure counter may be reset, and the commanded injection time may be compensated using an existing set compensation amount, when the deviation between the current injector driving condition and the injector driving condition in the step of determining the compensation amount is outside of the predetermined range.

The required commanded injection time may be recalculated by upwardly adjusting the required closing time when the number of sensing failures exceeds a reference value in the step of controlling the commanded injection time.

The sensing failure counter may be reset when the sensing failure counter succeeds in sensing the injector closing time in the step of sensing the injector closing time.

When it succeeds in sensing the injector closing time in the sensing an injector closing time, the sensing failure counter may be reset.

DESCRIPTION OF SPECIFIC EMBODIMENTS

Figure 1:
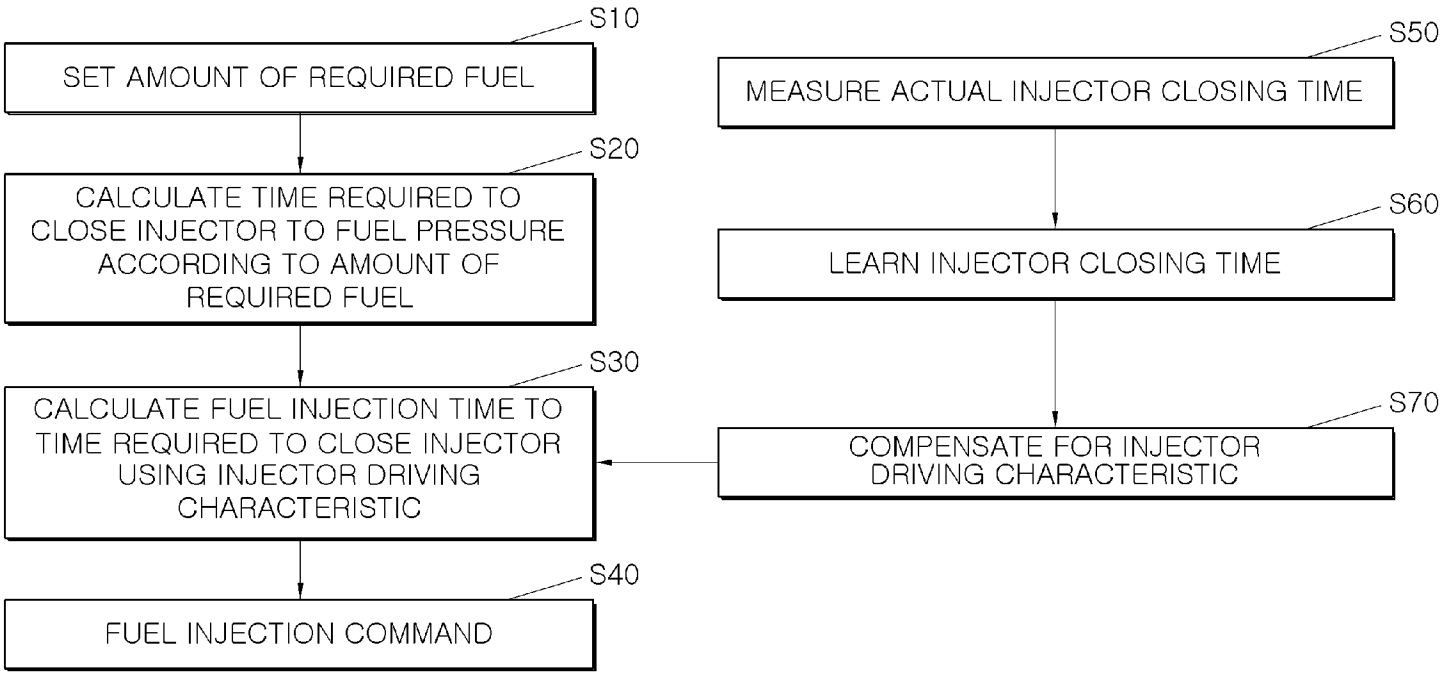
FIG. 1 is a flowchart schematically illustrating the precision control logic of an injector to which a method of correcting an injector driving characteristic according to an embodiment in the present disclosure is applicable.

Exemplary embodiments in the present disclosure will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments in the present disclosure.

FIG. 1 is a flowchart schematically illustrating the precision control logic of an injector to which a method of correcting an injector driving characteristic according to an exemplary embodiment in the present disclosure.

Figure 3A:
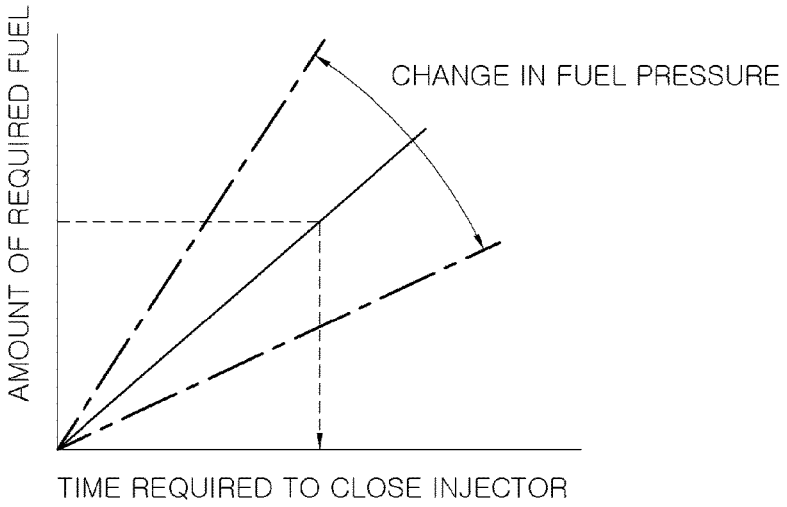
FIGS. 3A and 3B are graphs illustrating injector driving characteristics according to a change in fuel pressure.

As illustrated in FIG. 1, an ECU installed in a vehicle first sets an amount of fuel required when an engine is combusted (S10). The ECU calculates a time required to close an injector according to the amount of required fuel, using the linear data of time required to close an injector to fuel pressure according to the amount of required fuel for each cylinder, which is stored in a nonvolatile memory in the ECU (S20), as illustrated in FIG. 3A. Here, the injector closing time means a time taken to fully close the injector from immediately after an injector closing command is given by a closing signal transmitted to the injector from the ECU.

Figure 3B:
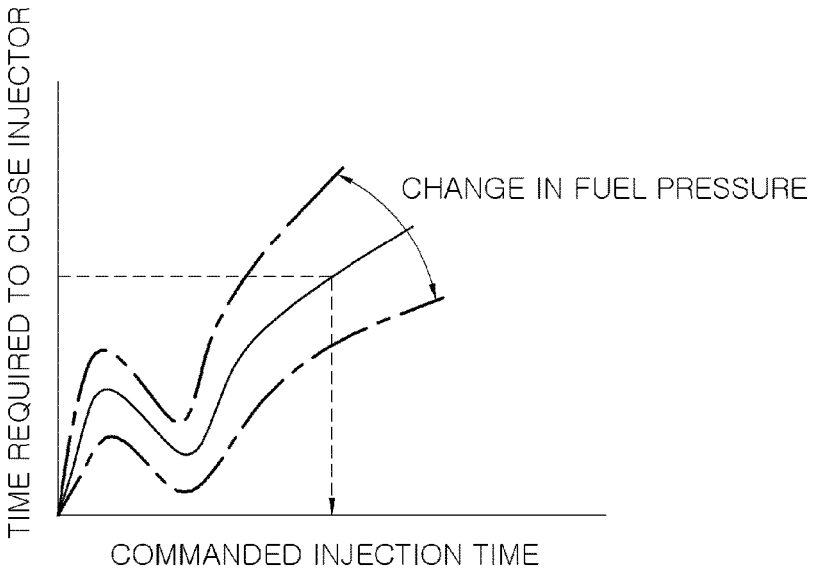

Next, the ECU calculates a fuel injection time corresponding to the calculated time required to close an injector for injection of required fuel, using the data of closing time to fuel pressure according to a required injection time of the injector, which is stored in the nonvolatile memory in the ECU (S30), as in an injector driving characteristic curve of FIG. 3B.

The ECU controls the injector such that the injector injects fuel into each cylinder, based on the calculated fuel injection time (S40).

Even when the same injector is used for each cylinder, injector driving characteristics may vary due to a manufacturing tolerance, or a tolerance of an output end of the injector operated by the ECU and thus a difference in the profile of operating current. As a result, a deviation may occur between the injection time and the closing time of the injector for each cylinder.

In order to compensate for this deviation, the precision control logic method of the injector measures an actual injector closing time for each cylinder (S50), and learns a relationship between the injection time and the actual closing time of the injector for each cylinder (S60). It is possible to remove the deviation of the injector closing time for each cylinder by compensating for an injector driving characteristic defining the relationship between the injection time and the closing time of the injector for each cylinder, based on the learned result (S70).

Figure 2A:
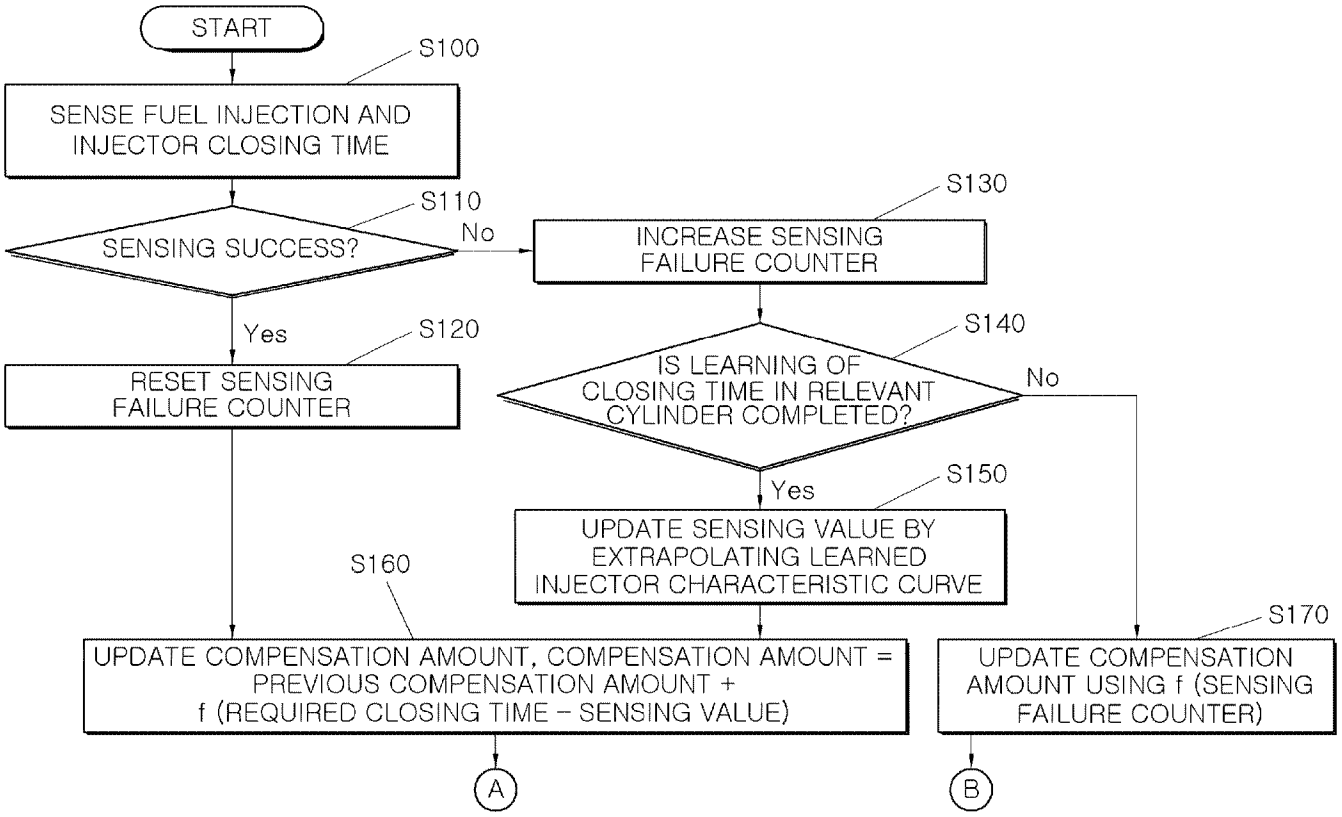
FIGS. 2A-2C are a flowchart illustrating the method of correcting an injector driving characteristic according to an exemplary embodiment in the present disclosure.
Figure 2B:
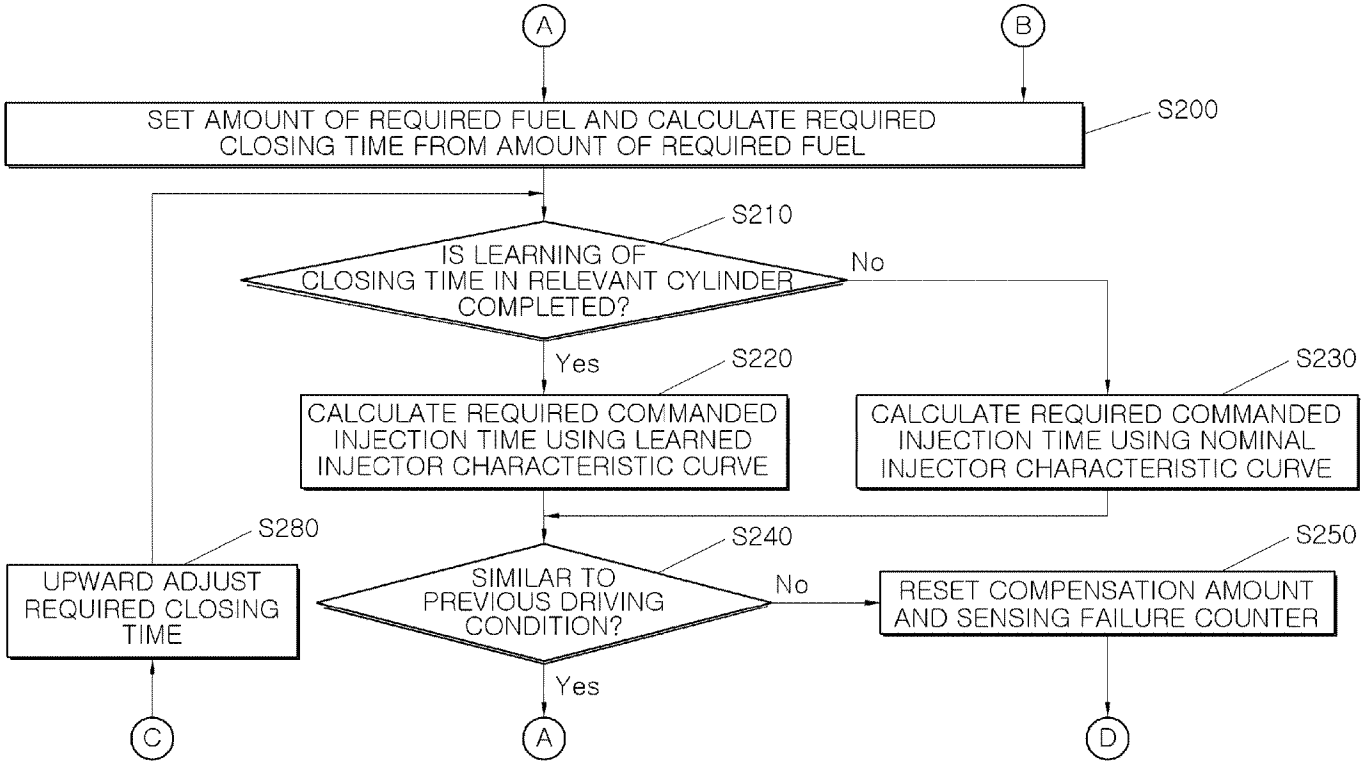
Figure 2C:
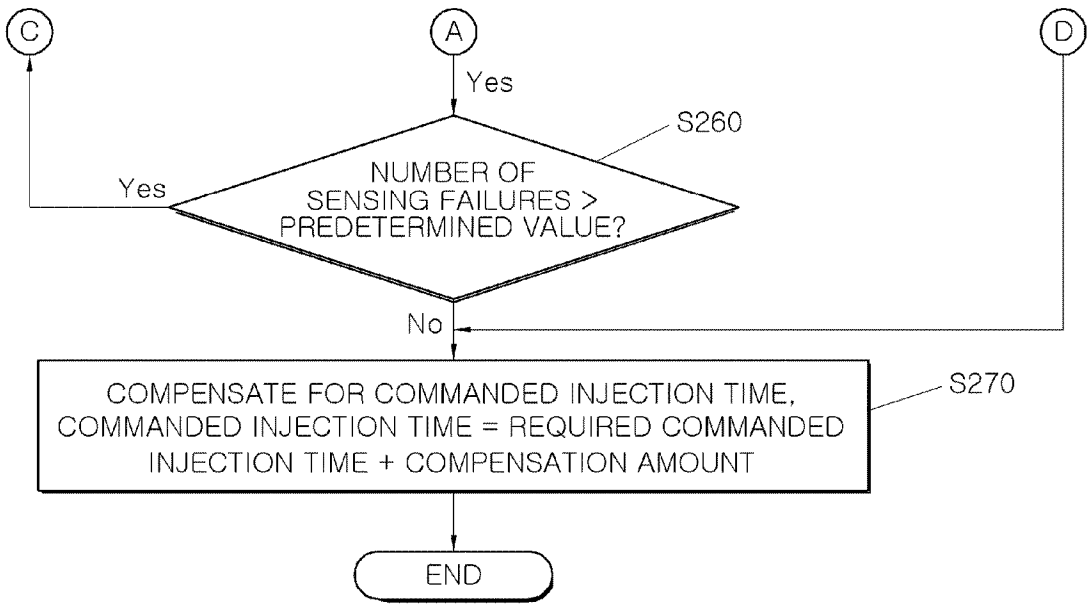

FIGS. 2A-2C is a flowchart illustrating the method of correcting an injector characteristic according to the present exemplary embodiment. The method of correcting an injector characteristic according to the present exemplary embodiment will be described in detail with reference to FIGS. 2A-2C.

In the method of correcting an injector characteristic according to the present exemplary embodiment, an ECU first senses an injector closing time (S100). The ECU may measure a change in driving voltage of an injector to measure the injector closing time. In more detail, the ECU senses a voltage consumed when the injector is driven using a voltage sensor connected to both nodes of the injector. The time at which the gradient of the sensed driving voltage is changed from (+) to 0 or (−) is determined to be an injector closing time, and the time taken to close the injector from when an injector closing command is given for each cylinder is measured as an actual injector closing time.

Figure 4A:
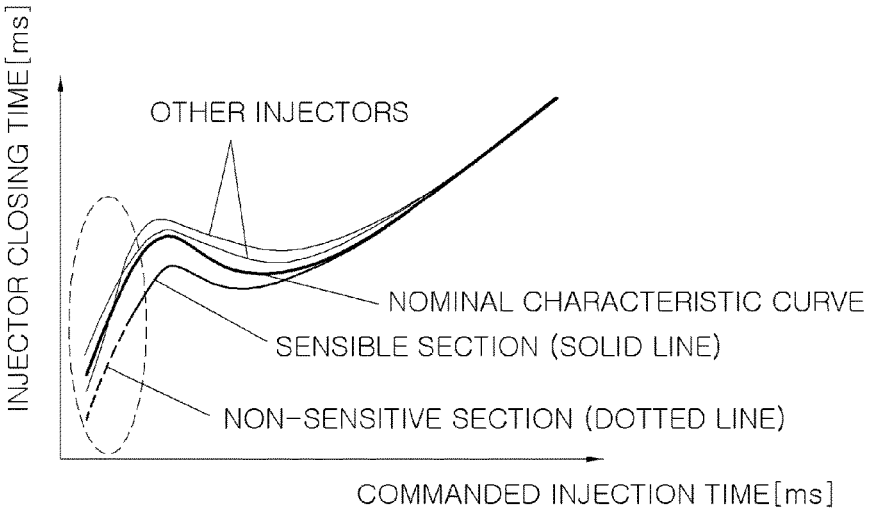
FIG. 4A is a graph illustrating an injector driving characteristic related to a relationship between an injector closing time and a commanded injection time.

However, as illustrated in FIG. 4A, since the needle of the injector is fully opened and then not closed in a small flow section, an induced electromotive force may be unclearly changed due to the motion change of the needle when magnetic energy is relatively emitted. For this reason, it may fail to sense the injector closing time since it is difficult to detect a point of inflection. Accordingly, a non-sensing region (a portion indicated by a dotted line) is present in the injector characteristic curve, as illustrated in FIG. 4A.

Since it may fail to sense the injector closing time in the non-sensing region, the ECU determines whether or not it fails to sense the injector closing time (S110). Here, the sensing failure of the injector closing time includes a case where the injector closing time is not sensible, a case where the injector closing time is inconsistently sensed or consistently drifted, etc.

When it fails to sense the injector closing time, the ECU increases a sensing failure counter which counts the number of repetitions of sensing failure (S130). The ECU determines a compensation amount for compensating for the commanded injection time according to whether or not the learning of the relationship between the injector closing time and the required commanded injection time for the relevant cylinder is completed (S140).

Figure 4B:
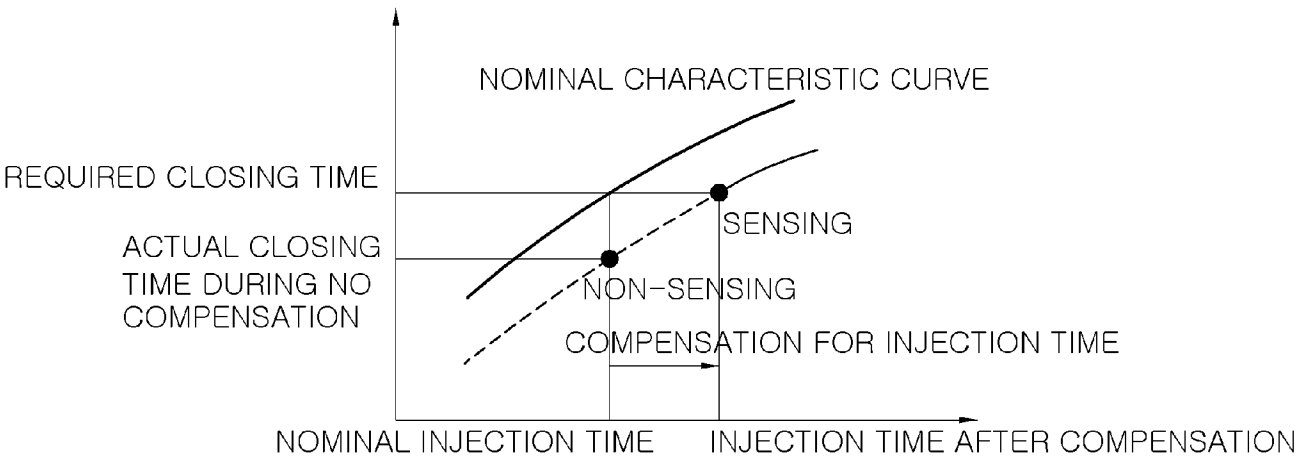
FIG. 4B is an enlarged graph illustrating a non-sensing region of FIG. 4A.

Specifically, when the learning of the relationship between the injector closing time and the required commanded injection time in the relevant cylinder is completed and the characteristic curve illustrated in FIGS. 4A and 4B is deduced, the characteristic curve in which the learning is completed is extrapolated to the non-sensing region so as to deduce a sensing value of the injector closing time to the required injection time (S150).

When it succeeds in sensing the injector closing time, the ECU resets the sensing failure counter (S120) since the problem about sensing failure is resolved, and determines the compensation amount for correcting the required commanded injection time using the measured sensing value of the injector closing time.

When the sensing value of the injector closing time is obtained in steps S100 and S130, the ECU determines the compensation amount for correcting the required commanded injection time corresponding to the specific amount of fuel injection, and updates the same (S160).

As described above, the actual injector driving characteristic differs from a predetermined nominal injector driving characteristic due to a manufacturing tolerance, or a tolerance of an output end of the injector operated by the ECU and thus a difference in the profile of operating current. The compensation amount for compensating for such a difference is determined.

Specifically, as illustrated in FIG. 4B, the compensation amount is a value obtained by subtracting the required injection time corresponding to the required closing time and the required injection time corresponding to the actual injector closing time on the injector characteristic curve. When the compensation amount which is previously stored in the ECU is present, it is updated as a new compensation amount by adding the calculated compensation amount to the previous stored compensation amount.

When the learning of the relationship between the injector closing time and the required commanded injection time in the relevant cylinder is not completed and the characteristic curve illustrated in FIGS. 4A and 4B is not deduced, so that the compensation amount is not determined based on the above method, the compensation amount is calculated as a function of the number of sensing failures counted by the sensing failure counter (S170).

Specifically, whenever the number of sensing failures is increased once, it is possible to increase the compensation amount by a certain amount in comparison with the previous set compensation amount. Alternatively, whenever the number of sensing failures reaches the number of specific sensing failures, it is possible to increase the compensation amount by a certain amount. As such, by properly adjusting the increase of the compensation amount according to the increase of the sensing failure counter, it is possible to determine the compensation amount so as to deduce a commanded injection time which is the closest to the commanded injection time corresponding to the actual injector closing time.

Hereinafter, the method of determining a compensation amount for the required injection command tine and then correcting the commanded injection time using the compensation amount will be described in detail.

First, the ECU sets an amount of fuel required for injection into a relevant cylinder, and calculates a time required to close an injector which is necessary to inject the amount of fuel into the cylinder (S200). As illustrated in FIG. 3A, the amount of required fuel and the time required to close an injector have a linear relationship specified according to a change in fuel pressure. Accordingly, it is possible to calculate the time required to close an injector according to a predetermined amount of required fuel in the specific fuel pressure, using the above characteristic.

Next, it is determined whether or not the learning of the relationship between an injector closing time and a required commanded injection time for the relevant cylinder is completed (S210). According to the determined result, the required commanded injection time is calculated according to the calculated time required to close an injector.

Specifically, when the learning of the relationship between the injector closing time and the required commanded injection time in the relevant cylinder is completed and the characteristic curve illustrated in FIG. 4A is deduced, the required commanded injection time according to the time required to close an injector is calculated using the characteristic curve in which the learning is completed (S220).

Meanwhile, when the learning of the relationship between the injector closing time and the required commanded injection time in the relevant cylinder is not completed and the characteristic curve illustrated in FIG. 4A is not deduced, the required commanded injection time according to the time required to close an injector is calculated using the nominal injector characteristic curve which is provided by the manufacturer and is previously stored in the ECU (S230).

After the required commanded injection time is calculated in steps S220 and S230, the ECU determines whether or not the current injector driving condition is similar to the previous injector driving condition (S240). That is, it is determined whether or not the injector driving condition before the injector characteristic is corrected is similar to the current injector driving condition when the injector characteristic is corrected. As illustrated in FIG. 3A, when the fuel pressure is changed, the injector driving characteristic curve is changed. Accordingly, when the commanded injection time is changed, the relationship between the required closing time and the commanded injection time varies.

Accordingly, it is determined whether or not the current driving condition during correction control is in a predetermined range by comparing the previous driving condition, such as the fuel pressure or the required commanded injection time, during correction control the fuel pressure or the required commanded injection time with the current driving condition.

When the injector driving condition before the injector characteristic is corrected differs from the current injector driving condition when the injector characteristic is corrected, it is difficult to update the previous compensation amount using the sensing value determined in steps S110 and S150 or the compensation amount determined in step S170. Therefore, the update on the compensation amount and the sensing failure counter is removed and the compensation amount and the sensing failure counter are reset again (S250).

when the number of sensing failures exceeds a predetermined number of times, the required closing time is too low. Therefore, it is impossible to accurately compensate for the commanded injection time related to the amount of fuel injection.

Accordingly, it is determined whether or not the sensing failure counter exceeds the predetermined number of times (S260). When the sensing failure counter exceeds the predetermined number of times, the required closing time is controlled to be adjusted upward (S280). The required commanded injection time is calculated again based on the required closing time which is adjusted upward.

In this case, the ECU adjusts the amount of injection in an injection mode such that required closing time is adjusted upward, or controls a fuel pump and an injector such that an injection ratio is changed in a multiple injection mode.

When the sensing failure counter is equal to or less than the predetermined number of times, the ECU updates the commanded injection time by applying the compensation amount updated in step S160 or S170 (S270).

Specifically, the commanded injection time is updated by adding the compensation amount updated in step S160 or S170 to the required commanded injection time calculated in step S220 or S230.

The ECU controls the injector such that fuel is injected by the commanded injection time updated in step S270.

In accordance with the method of correcting an injector characteristic according to the present exemplary embodiment, when the fuel is injected using the injector, it is possible to accurately control the amount of fuel even in the small flow section in which it is difficult to sense the injector closing time. In addition, the present exemplary embodiment makes it possible to accurately correct the deviation of the injector closing time for each cylinder.

In accordance with a method of correcting an injector driving characteristic according to exemplary embodiments in the present disclosure, it is possible to deduce a compensation amount of a required command time for injection to an injector closing time even in a small flow section in which it is difficult to sense the injector closing time. Therefore, it is possible to accurately control an amount of fuel even in the small flow section in which it is difficult to sense the injector closing time.

It is possible to accurately correct a deviation between injector closing times through this method, and the correction of closing time deviation for each cylinder can be improved.

While the present invention has been described with respect to the specific embodiments, it will be apparent to those skilled in the art that various changes and modifications may be made without departing from the spirit and scope of the invention as defined in the following claims.

What is claimed is:

1. A method for correcting an injector characteristic defining a relationship between an injector injection time and a valve closing time for a cylinder of an internal combustion engine by sensing an injector closing time, the method comprising steps of:

sensing the injector closing time;

determining a compensation amount for compensating for a commanded injection time using a number of sensing failures or a result of a learning of a relationship between a required commanded injection time and the injector closing time in a relevant cylinder, in addition to a count of the number of sensing failures by sensing failure counter when there is a failure to sense the injector closing time; and controlling a commanded injection time according to an amount of required fuel injection in the relevant cylinder, based on the determined compensation amount, wherein:

a sensing value of the injector closing time is determined by extrapolating a characteristic curve in which the learning is completed when the learning of the injector closing time in the relevant cylinder is completed in the step of determining the compensation amount for compensating for the commanded injection time; and the compensation amount for compensating for the commanded injection time is determined using a determined sensing value of the injector closing time and a deviation of a time required to close an injector.

2. The method of claim 1, wherein:

the compensation amount is determined according to a relationship between the compensation amount and the number of sensing failures when the injector closing time in the relevant cylinder is not completed in the step of determining the compensation amount; and the compensation amount for compensating for the commanded injection time is determined using a sensing value of the injector closing time and a deviation of a time required to close an injector.

3. The method of claim 1, wherein the step of controlling the commanded injection time comprises steps of:

setting an amount of required fuel injection;

calculating a time required to close an injector from the set amount of required fuel injection;

calculating the required commanded injection time from the calculated time required to close an injector; and determining the commanded injection time using the calculated required commanded injection time and the determined compensation amount.

4. The method of claim 2, wherein the step of controlling the commanded injection time comprises steps of:

setting an amount of required fuel injection;

calculating a time required to close the injector from the set amount of required fuel injection;

calculating the required commanded injection time from the calculated time required to close the injector; and determining the commanded injection time using the calculated required commanded injection time and the determined compensation amount.

5. The method of claim 3, wherein the required commanded injection time is calculated from an injector characteristic curve in which the learning is completed after the determining of the commanded injection time and the injector closing time in the step of calculating the required commanded injection time.

6. The method of claim 4, wherein the required commanded injection time is calculated from an injector characteristic curve in which the learning is completed when the after the determining of the commanded injection time and the injector closing time in the step of calculating the required commanded injection time.

7. The method of claim 3, wherein the required commanded injection time is calculated from a nominal injector characteristic curve which is previously set when a vehicle is manufactured when the learning of the commanded injection time and the injector closing time in the relevant cylinder is not completed in the step of calculating the required commanded injection time.

8. The method of claim 4, wherein the required commanded injection time is calculated from a nominal injector characteristic curve which is previously set when a vehicle is manufactured when the learning of the commanded injection time and the injector closing time in the relevant cylinder is not completed in the step of calculating the required commanded injection time.

9. The method of claim 3, wherein the commanded injection time is compensated using the determined compensation amount when a deviation between a current injector driving condition and an injector driving condition when the compensation amount is determined, is within a predetermined range.

10. The method of claim 5, wherein the commanded injection time is compensated using the determined compensation amount when a deviation between a current injector driving condition and an injector driving condition when the compensation amount is determined, is within a predetermined range.

11. The method of claim 9, wherein the determined compensation amount and the sensing failure counter are reset, and the commanded injection time is compensated using an existing set compensation amount, when the deviation between the current injector driving condition and the injector driving condition in the step of determining the compensation amount is outside of a predetermined range.

12. The method of claim 3, wherein the required commanded injection time is recalculated by upwardly adjusting the required closing time when the number of sensing failures exceeds a reference value in the controlling a commanded injection time.

13. The method of claim 4, wherein the required commanded injection time is recalculated by upwardly adjusting the required closing time when the number of sensing failures exceeds a reference value in the step of controlling the commanded injection time.

14. The method of claim 1, wherein the sensing failure counter is reset when the sensing failure counter succeeds in sensing the injector closing time in the step of sensing the injector closing time.

15. The method of claim 10, wherein the determined compensation amount and the sensing failure counter are reset, and the commanded injection time is compensated using an existing set compensation amount, when the deviation between the current injector driving condition and the injector driving condition in the step of determining the compensation amount is outside of a predetermined range.

* * * * *